United States Patent [19]

Kelly

[11] 4,445,261

[45] May 1, 1984

[54] METHOD FOR INSTALLING TUBES IN A TUBE SHEET

[75] Inventor: John W. Kelly, Burbank, Calif.

[73] Assignee: Haskel, Incorporated, Burbank, Calif.

[21] Appl. No.: 173,142

[22] Filed: Jul. 28, 1980

[51] Int. Cl.[3] ..... B23P 15/26; B23P 11/02

[52] U.S. Cl. ..... 29/157.4; 29/157.3 C

[58] Field of Search ..... 29/157.3 C, 157.4, 157.3 A, 29/157.3 B, 157.4, 523; 113/118 A, 118 B

[56] References Cited

U.S. PATENT DOCUMENTS 3,977,068 8/1976 Krips ..... 29/157.4

4,069,573 1/1978 Rogers, Jr. et al. ..... 29/157.3 C

*Primary Examiner*—Francis S. Husar

*Assistant Examiner*—V. K. Rising

*Attorney, Agent, or Firm*—Fulwider, Patton, Rieber, Lee & Utecht

[57] ABSTRACT

A tube is inserted in a bore in a tube sheet, the tube having an outside diameter slightly smaller than the bore. Hydraulic pressure is applied to the tube internally to expand it radially throughout a pressure zone that extends at least up to one end of the bore. The pressure is confined between two axially spaced seals that encircle a mandrel and are engagable with the inner surface of the tube. The mandrel and seals are then shifted to relocate the pressure zone so that it does not reach the end, and increased pressure is applied to produce a firmer contact between the outside of the tube and the bore. Any crevices between the tube and the tube sheet in which corrosion would be likely to occur are thus eliminated. The invention is particularly suitable for use in connection with the heat exchangers of nuclear plants.

8 Claims, 5 Drawing Figures

METHOD FOR INSTALLING TUBES IN A TUBE SHEET

FIELD OF THE INVENTION

The present invention relates to the installation of tubes in tube sheets, and, more particularly, to the use of hydraulic pressure to expand the tubes radially against the surfaces of the bores in which they are received.

BACKGROUND OF THE INVENTION

There are numerous situations in which a tube is inserted in a tube sheet, as in a boiler, and it is highly desirable to provide close contact in the nature of an interference fit between the external surface of the tube and the surface of the bore. If a crevice remains surrounding the tube, it may serve as a starting point for destructive corrosion.

A tube sheet structure in which particularly high standards must be met and severe corrosion problems may be encountered is found in the heat exchangers of nuclear power plants. In this environment, the tube sheet is in the form of a steel plate several feet thick through which bores extend transversely to receive tubes. The interfaces between the tube sheet and the tubes on the secondary side of the tube sheet are exposed to water, extremely high temperature and changing pressure. If crevices remain or are formed later between the tubes and the tube sheet, a substantially increased possibility exists for corrosive action, requiring a reduction in the estimated minimum life-expectancy of the structure. It is, therefore, crucial that any such crevice formation be minimized or eliminated in a highly predictable and repeatable manner. Moreover, a technique that requires a minimum of time is desirable because upward of a thousand tubes may pass through a single tube sheet.

It is known to seal the outer surface of a tube against the surrounding surface of a bore by applying hydraulic pressure to the interior of the tube, thus expanding the tube. Sufficiently high pressure is applied to expand the bore radially by elastically deforming the tube sheet while plastically deforming the tube. When the pressure is removed, the bore contracts and compresses the tube. The pressure is applied by a mandrel that is inserted in the tube. Axially spaced seals encircle the mandrel to define a pressure zone between them within which this radial expansion takes place.

A critical area in which it is difficult to obtain the desired controlled expansion of the tube is at the end of the bore at the secondary side of the tube sheet. If the seal at that end of the mandrel is positioned slightly beyond the surface of the tube sheet, an annular bulge will be created when the pressure is applied, since radial expansion forces will exist in a portion of the tube that protrudes from the tube sheet and is not confined within the bore. This bulge will act as a stress riser and will significantly reduce the strength and integrity of the tube.

To avoid the formation of such secondary end bulges, it has been necessary to position the inner seal of the mandrel so that it is within the bore, spaced from the secondary surface of the tube sheet. While this technique solves the problem of bulge formation, it often allows a small crevice to remain on the secondary side of the tube sheet at precisely the location exposed to the most intensive corrosive action.

It is an objective of the present invention to provide an improved method for installing tubes that permits the elimination or substantial reduction of any such crevice without resulting in the formation of a bulge.

SUMMARY OF THE INVENTION

The present invention relates to a method that accomplishes the above objective by the application of pressure to a tube in two stages. The tube is inserted in a bore of a tube sheet, the tube having an outside diameter slightly smaller than the diameter of the bore. Hydraulic pressure is applied to the tube internally to expand it radially throughout a pressure zone that extends axially along the tube, up to one end of the bore or beyond. The pressure is not high enough to form a bulge in the tube if the pressure should extend beyond the secondary surface of the tube sheet. Increased hydraulic pressure is then applied to the tube after shifting the pressure zone so that it extends axially along the tube, but stops short of the end of the bore. While this increased pressure would be sufficient to form a bulge, it is known, at this stage, that the pressure zone is confined within the tube sheet.

A technique for applying hydraulic pressure in the desired manner employs a mandrel inserted in the tube. Hydraulic fluid is introduced through the mandrel into an annular space between the mandrel and the tube. Seals carried by the mandrel and engagable with the inner surface of the tube define the ends of the pressure zone.

The above technique is employed to particular advantage in connection with the heat exchanger of a nuclear power plant. The mandrel is inserted in the tube, working from the primary side (the outside of the exchanger). The secondary surface of the tube sheet serves as a reference point with respect to the location of the pressure zone.

Since a large number of tubes must be installed in a single tube sheet, the mandrel is inserted sequentially in successive tubes. Each bore is of the same length, and the operation can be automated by employing a mandrel to which first and second stop surfaces are attached. The second stop surface, which is movable with respect to the mandrel, is initially placed in a non-engaging position to permit the mandrel to be inserted up to the point at which the first stop surface abuts against the primary surface of the tube sheet, thus positioning the inner seal at the desired location in which the pressure zone extends at least up to the secondary surface and preferably beyond it. The mandrel is then partially removed from the tube and the second stop surface is placed in an engaging position. When the mandrel is reinserted until engagement by the first stop surface takes place, the inner seal stops short of the secondary surface and the higher pressure can be applied.

Other features and advantages of the present invention will become apparent from the following detailed description taken in connection with the accompanying drawings, which illustrate, by way of example, the principles of the invention.

DESCRIPTION OF THE PREFERRED EMBODIMENT

Figure 1:
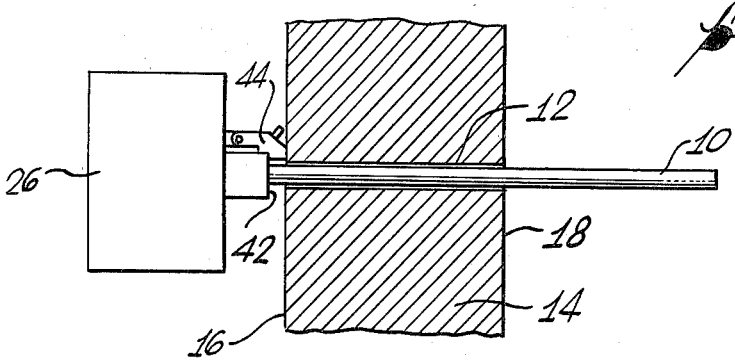
FIG. 1 is pictorial illustration of a mandrel inserted in a bore of a tube sheet, the tube sheet being shown in cross section.

A representative tube 10 is to be installed within a bore 12 of a tube sheet 14, as shown in FIG. 1 of the accompanying drawings. The bore 12 extends transversely through the tube sheet 14 perpendicular to its primary and secondary surfaces, 16 and 18, and is of a slightly larger diameter than the outside of the tube 10.

In the environment of the heat exchanger of a nuclear power plant there would be upward of a thousand tubes 10 passing through a single tube sheet 14. While these tubes 10 protrude only slightly or not at all from the primary side 16 of the tube sheet 14, they extend considerably beyond the secondary or interior surface 18.

Figure 2:
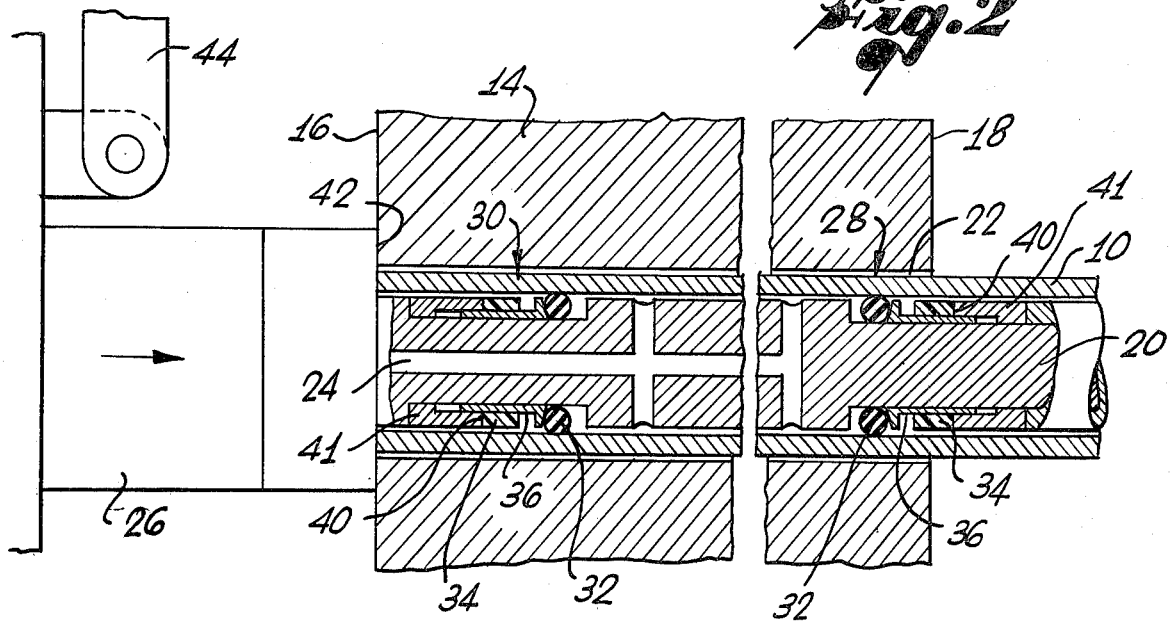
FIG. 2 an enlarged and more detailed view showing the mandrel in position for the first stage of pressure application, the tube sheet, tube and mandrel being shown in cross section.

Working from the primary side 16, a mandrel 20 (not visible in FIG. 1) is inserted in the tube 10, as shown in FIG. 2. The mandrel 20 is of lesser diameter than the inside diameter of the tube 10 so that a small annular gap 22 exists between the mandrel and the tube through which pressurized hydraulic fluid, preferably water, can enter through a passageway 24 that extends axially along the mandrel. The pressurized fluid is supplied by a power head 26 attached to the mandrel 20. The details of the power head 26 are not shown or described here since a power head of a particular construction is not necessary to the practice of the invention.

Near each end of the mandrel 20 is a seal 28, 30 that, upon the application of hydraulic pressure, expands radially to engage the inner surface of the tube 10, thus defining a pressure zone that extends axially along the mandrel between the two seals. According to a preferred seal construction, illustrated in FIGS. 2–5, each seal 28, 30 includes an O-ring 32 on its high pressure side and a ring-shaped polyurethane back-up member 34 on its low pressure side. A sleeve 36 that slides axially on the mandrel 20 is encircled by the back-up member 34 and the body of the mandrel 20 serves as a support for the sleeve. The back-up member 34 is confined axially between a flange 38 carried by the sleeve 36 and an abutment portion 40 of the mandrel 20. The abutment 40 is formed at the end of a ring-shaped mandrel component 41 that is undercut to receive the sleeve 36. When hydraulic pressure is applied, the seal 28, 30 is compressed axially against the abutment 40, and the O-ring 32 and back-up member 34 are thus caused to expand radially against the inner surface of the tube 10 to prevent the escape of hydraulic fluid from the pressure zone.

An important advantage of this seal construction is that it is self-centering radially within the tube 10 because the sleeve 36 fits slidably but closely on the mandrel 20 and cannot be cocked. The back-up member 34 is, therefore, forced to expand equally in all directions to center the mandrel 20. Centering of the mandrel 20 insures that the annular gap 22 is of a uniform dimension thoughout the circumference of the mandrel 20, thereby minimizing any tendency of the back-up member 34 to extrude into the gap 22 and deform plastically.

While the seal construction described here is preferred, it is not essential to the practice of the invention. Other seals may be used, provided they perform the essential function of cdnfining hydraulic fluid to a pressure zone that extends axially along the tube 10.

The mandrel 20 carries two stops 42 and 44 which prevents a stop surface that limits the insertion of the mandrel into the tube 10. The first of these stops 42 is an immovable shoulder that is engagable with the primary surface 16 of the tube sheet 14. The second such stop 44 is movable between a non-engaging position, shown in FIGS. 2 and 3, and an engaging position, shown in FIGS. 4 and 5, in which it contacts the primary surface 16 of the tube sheet 14 before contact is made with the first stop 42. Thus, the extent to which the mandrel 20 can be inserted in the tube 10 is more limited when the movable second stop 44 occupies its engaging position.

Figure 3:
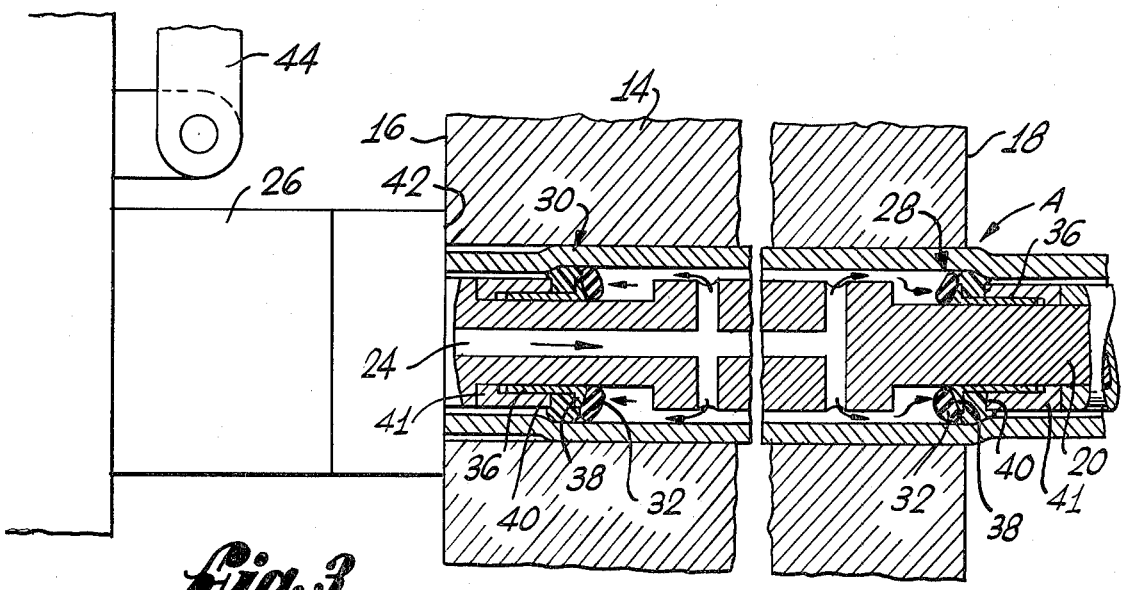
FIG. 3 is a cross-sectional view similar to FIG. 2 but shown after the pressure has been applied.

The mandrel 20 is first inserted in the tube 10 with the movable stop 44 in its non-engaging position, as shown in FIG. 2. When the first stop 42 contacts the primary surface 16 of the tube sheet 14, the pressure zone within which radial expansion of the tube 10 will take place extends at least up to the secondary surface 18 of the tube sheet and preferably extends slightly beyond that surface, as determined by the precise position of the inner seal 28. Hydraulic working fluid is then introduced into the annular gap 22 surrounding the mandrel 20 as shown in FIG. 3, and the tube 10 is expanded radially (any expansion of the bore being imperceptible in the drawings). At this point, however, the hydraulic pressure is limited to a value significantly less than that which would be applied to obtain the full desired contact between the outer surface of the tube 10 and the bore 12.

The pressure applied in this first stage is not sufficient to form a bulge in the tube 10 at the location A (FIG. 3) if the inner seal 28 is positioned beyond of the secondary tube sheet surface 18. Thus, it is the pressure at which such bulging begins to take place that determines the upper limit of the hydraulic pressure that should be applied during this stage.

Figure 4:
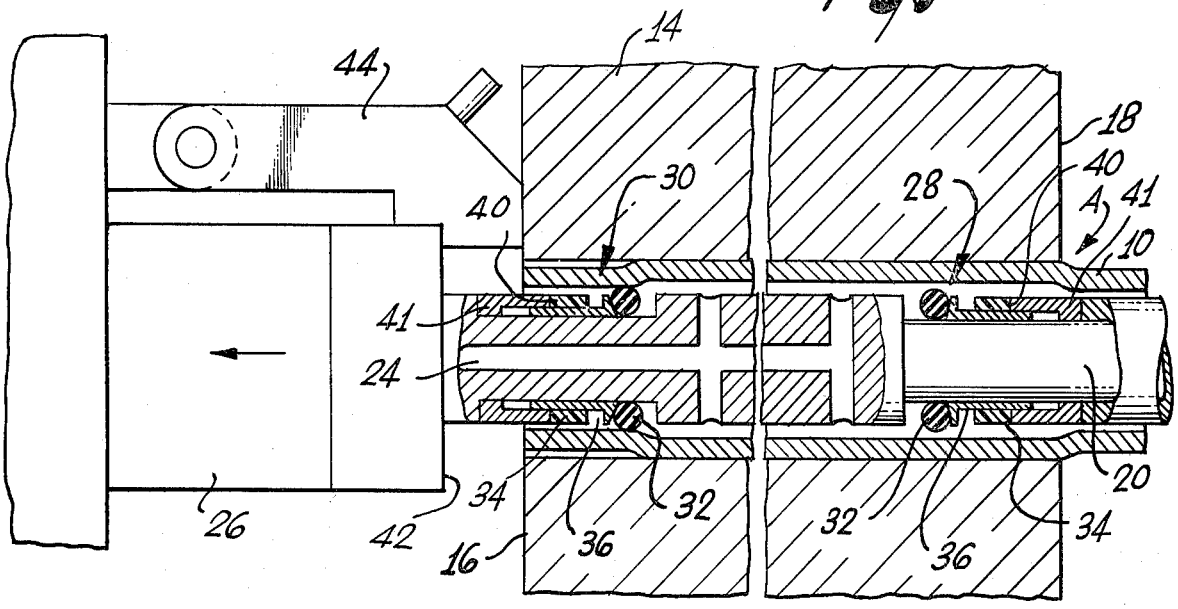
FIG. 4 is similar to FIG. 2 showing the mandrel in position for the second stage of pressure application.
Figure 5:
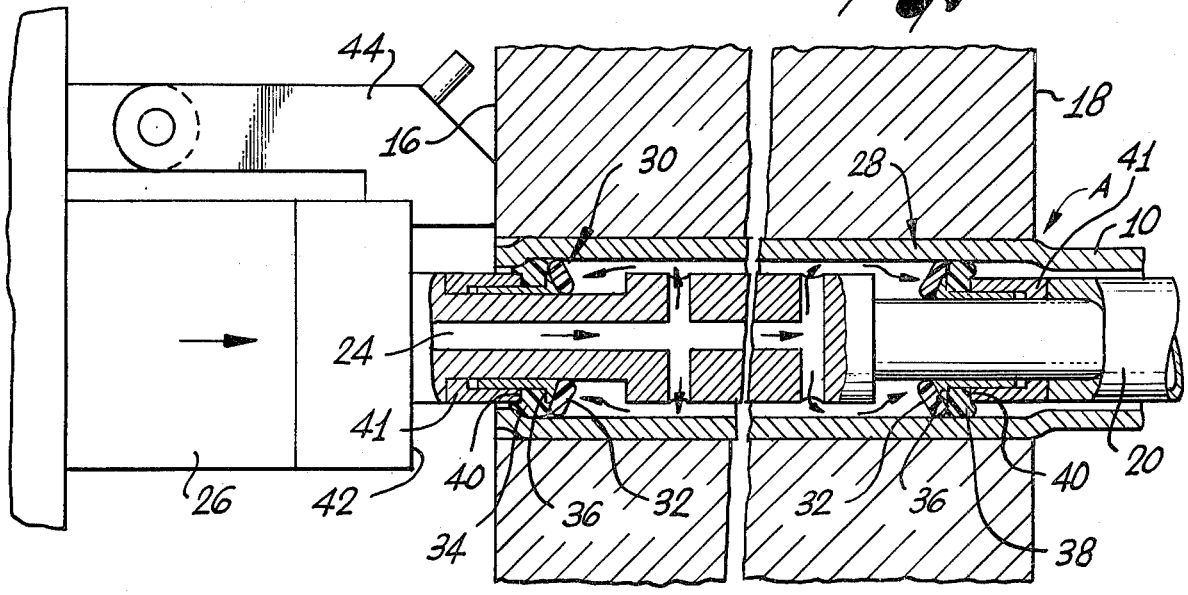
FIG. 5 is similar to FIG. 4 but shown after the pressure has been applied.

Next, the mandrel 20 is partially withdrawn from the tube 10 and the movable second stop 44 is placed in its engaging position. The mandrel is then reinserted until the second stop 44 engages the primary surface of the tube sheet, as shown in FIG. 4. The mandrel 20 cannot be inserted to the extent that it could during the first pressurization stage, and the inner seal 28 will be well within the bore 12 and spaced from secondary tube sheet surface 18. Full hydraulic pressure is then applied to produce firmer contact between the tube 10 and the tube sheet 14. Since at this time it is known that the inner seal 28 is within the tube sheet 14, regardless of any tolerance variations, the pressure which would produce a bulge in an unconfined section of tube 10 can be safely exceeded. After the tube 10 is thus expanded radially at the higher pressure, the mandrel 20 is withdrawn and the process is repeated with respect to another tube 10.

By way of example, and for purposes of illustration, without in any way limiting the scope of the invention, it has been found that a first stage pressure of 10,000 psi might be desirable when a second stage pressure of 30,000 psi is appropriate. However, the actual pressure limits must be determined by the characteristics of the tubes 10 and tube sheet 14 being used.

While a particular form of the invention has been illustrated and described, it will be apparent that various modifications can be made without departing from the spirit and scope of the invention.

I claim:

1. A method for installing a tube in a tube sheet comprising:

inserting a tube into a bore that extends through said tube sheet, said tube having an outside diameter slightly smaller than the diameter of said bore;

applying hydraulic pressure internally to said tube to expand said tube radially throughout a first pressure zone that extends axially along said tube, within said bore, at least up to one end of said bore; and applying increased hydraulic pressure internally to said tube to expand said tube radially throughout a second pressure zone that overlaps said first pressure zone and extends axially along said tube, within said bore, but not to said end of said bore.

2. The method of claim 1 wherein said hydraulic pressures are applied by inserting a mandrel in said tube, the positions of said pressure zones within said bore being determined by the positions of said mandrel.

3. The method of claim 1 wherein said hydraulic pressure is applied by inserting in said tube an elongated mandrel having axially separated seals that are engagable with the inner surface of said tube, the positions of said pressure zones within said bore being defined by the axial positions of said mandrel and the corresponding positions of said seals.

4. A method for installing a tube in a tube sheet comprising:

inserting a tube into a bore that extends through said tube sheet, said tube having an outside diameter slightly smaller than the diameter of said bore;

inserting in said tube a mandrel having a pair of spaced-apart seals each of which is engagable with the inner surface of said tube;

axially positioning said mandrel so that a first pressure zone defined between said seals and within said bore extends at least up to one end of said bore;

introducing a working fluid at a first predetermined pressure through said mandrel into an annular space that extends axially throughout said first pressure zone between said mandrel and said tube, and thereby expanding said tube radially into contact with the inner surface of said bore;

reposition said mandrel so that a second pressure zone is defined between said seals and within said bore that overlaps said first pressure zone and does not extend to said one end of said bore; and introducing said working fluid at a second predetermined pressure, that is substantially greater than said first predetermined pressure, through said mandrel into said annular space between said mandrel and said tube, and thereby further expanding said tube into firmer contact with said bore.

5. A method for installing a tube in a tube sheet comprising:

inserting a tube into a bore that extends transversely through said tube sheet, said tube having an outside diameter slightly smaller than the diameter of said bore;

providing a mandrel having a pair of axially separated seals thereon and first and second stop surfaces thereon;

setting said second stop surface in a non-engaging position;

inserting said mandrel in said tube;

axially positioning said mandrel so that said seals define a first pressure zone within said bore that extends at least up to one end of said bore and said first stop surface engages said tube sheet;

introducing a working fluid at a first predetermined pressure through said mandrel into an annular space between said mandrel and said tube that extends axially throughout said first pressure zone, and thereby expanding said tube radially into contact with the surface of said bore;

moving said second stop surface to an engaging position;

repositioning said mandrel so that said seals define a second pressure zone within said bore that overlaps said first pressure zone but does not extend to said one end of said bore and said second stop surface engages said tube sheet; and introducing said working fluid at a second predetermined pressure, that is substantially greater than said first predetermined pressure, through said mandrel into said annular space between said mandrel and said tube, and thereby further expanding said tube into firmer contact with said bore.

6. A method for installing tubes in a heat exchanger of a nuclear power plant comprising:

forming a plurality of transverse bores in a tube sheet;

inserting a tube into each of said bores, each such tube having an outside diameter slightly smaller than the diameter of the corresponding bore;

inserting sequentially in each of said tubes, from the primary side of said tube sheet, a mandrel having a pair of axially separated seals that are engagable with the inner surfaces of the tubes;

axially positioning said mandrel so that a first pressure zone defined between said seals and within said bore extends at least up to the secondary side of said tube sheet;

introducing a working fluid at a first predetermined pressure through said mandrel into an annular space between said mandrel and each of said tubes that extends axially throughout said first pressure zone, and thereby expanding said tubes radially into contact with the inner surface of said bore;

repositioning said mandrel within each of said tubes so that a second pressure zone defined between said seals, within said bore and overlapping said first pressure zone does not extend to said secondary side of said bore; and introducing said working fluid at a second predetermined pressure, that is substantailly greater than said first predetermined pressure, through said mandrel into said annular space between said mandrel and each of said tubes, and thereby further expanding said tubes into firmer contact with said bores.

7. The method of claim 6 comprising the further steps of:

causing a first stop surface carried by said mandrel to engage the primary surface of said tube sheet to determine the first mentioned position of said mandrel;

moving a second stop surface carried by said mandrel to permit engagement thereof with said primary surface; and causing said second stop surface to engage the primary surface of said tube sheet to determine the second mentioned position of said mandrel.

8. The method of claim 6 wherein said working fluid is introduced to each of said tubes at said first pressure and then at said second pressure before proceeding to the next successive one of said tubes.

* * * * *